US007075095B2

(12) United States Patent
Kornfeld et al.

(10) Patent No.: US 7,075,095 B2
(45) Date of Patent: Jul. 11, 2006

(54) PLASMA ACCELERATOR SYSTEM

(75) Inventors: Günter Kornfeld, Elchingen (DE); Gregory Coustou, Sandillon (DE); Gregory Emsellem, Paris (FR)

(73) Assignee: Thales Electron Devices GmbH, Ulm (DE)

( * ) Notice: Subject to any disclaimer, the term of this patent is extended or adjusted under 35 U.S.C. 154(b) by 0 days.

(21) Appl. No.: 10/494,147

(22) PCT Filed: Oct. 30, 2002

(86) PCT No.: PCT/EP02/12095

§ 371 (c)(1),
(2), (4) Date: Nov. 26, 2004

(87) PCT Pub. No.: WO03/039215

PCT Pub. Date: May 8, 2003

(65) Prior Publication Data

US 2005/0174063 A1 Aug. 11, 2005

(30) Foreign Application Priority Data

Oct. 31, 2001 (DE) ..... 101 53 723

(51) Int. Cl.
*A61N 5/00* (2006.01)

(52) U.S. Cl. ..... 250/492.21; 60/202; 315/111.01

(58) Field of Classification Search ..... 315/111.01–111.91; 250/492.21, 398, 492.2, 250/423 R, 287, 288; 60/202, 203.1
See application file for complete search history.

(56) References Cited

U.S. PATENT DOCUMENTS

| | | | | |
|---|---|---|---|---|
| 5,365,070 | A * | 11/1994 | Anderson et al. | 250/423 R |
| 5,563,418 | A * | 10/1996 | Leung | 250/492.21 |
| 5,847,493 | A | 12/1998 | Yashnov et al. | 313/231.31 |
| 6,215,124 | B1 | 4/2001 | King | 250/423 R |
| 6,523,338 | B1 * | 2/2003 | Kornfeld et al. | 60/202 |
| 6,525,326 | B1 * | 2/2003 | Harrington et al. | 250/492.21 |
| 6,600,155 | B1 * | 7/2003 | Andrien et al. | 250/287 |

FOREIGN PATENT DOCUMENTS

| | | |
|---|---|---|
| DE | 1222589 | 8/1966 |
| DE | 19828704 | 12/1999 |
| DE | 100 14 033 | 10/2001 |
| DE | 100 14 034 | 10/2001 |
| EP | 054309 | 6/1982 |
| JP | 09223474 | 8/1997 |

* cited by examiner

*Primary Examiner*—Wilson Lee
(74) *Attorney, Agent, or Firm*—Collard & Roe, P.C.

(57) ABSTRACT

A multistage plasma accelerator system includes at least one intermediate electrode between the plasma chamber between electrodes that include each other. An especially good efficiency can be achieved by way of an uneven distribution of potential to the potential stages formed by the plurality of electrodes having a high potential gradient of the last stage, when the plasma beam emerges, and by a special shape of the magnetic field prevailing in the plasma chamber of the last stage.

11 Claims, 2 Drawing Sheets

PLASMA ACCELERATOR SYSTEM

CROSS REFERENCE TO RELATED APPLICATIONS

Applicants claim priority under 35 U.S.C. §119 of German Application No. 101 53 723.9 filed Oct. 31, 2001. Applicants also claim priority under 35 U.S.C. §365 of PCT/EP02/12095 filed Oct. 30, 2002. The international application under PCT article 21(2) was not published in English. The invention relates to a plasma accelerator system.

BACKGROUND OF THE INVENTION

1. Field of the Invention

Plasma accelerator systems serve, for example, as drives for space missiles. In this connection, a working gas is ionized in a plasma chamber, and the ions are accelerated in an electrostatic field and expelled as a neutralized plasma beam, by means of electrons that are supplied.

2. The Prior Art

The most common embodiment type of such plasma accelerator systems is the so-called Hall thruster, whose ring-shaped plasma chamber has an essentially radial static magnet passing through it. Such Hall thrusters are known, for example, from EP 0541309 A1 or U.S. Pat. No. 5,847,493.

In the case of these Hall thrusters, an electron source arranged outside of the plasma chamber, on the side of its beam exit, and laterally offset relative to the latter, emits an electron stream that is partly passed into the plasma chamber, under the influence of the electric field between the electron source and an anode arranged at the bottom of the plasma chamber, as ionization electrons, and partly carried along by the ions that exit from the chamber, as neutralization electrons. The ionization electrons are deflected in the plasma chamber, under the influence of the magnetic field, and form ring-shaped drift streams, whereby the duration time and the ionization effect on the working gas that is introduced into the plasma chamber is significantly increased.

DE-AS 1222589 shows a plasma accelerator system, in which an arc discharge is ignited in a plasma chamber delimited in length by an anode and a cathode. The resulting ions are drawn off by a ring-shaped ion acceleration electrode arranged outside of the plasma chamber and separated from the latter by an insulated electrode, and expelled in accelerated manner. An energy-rich bundled electron beam supplied from the cathode side, on the center axis of the system, runs through the plasma chamber and exits through the acceleration electrode with the electrons of the electron beam, and neutralizes the ion beam. The electrons that are formed during the arc discharge and the electrons of the supplied beam that are braked by means of pulse processes perform an oscillating movement between the ion acceleration electrode and the cathode. A magnetic collimator field that runs parallel to the longitudinal axis bundles the particle streams about the center axis. Additional electrostatic acceleration stages having magnetic bundling can follow the acceleration electrode.

A plasma accelerator is described in Patent Abstracts of Japan 09223474, which has a plasma generator chamber and a plasma accelerator chamber, one after the other, through which working gas is passed, in each instance. A coil arrangement generates a beam-parallel magnetic field. Several stabilization electrodes that surround the beam are arranged in the two chambers, one after the other.

A plasma accelerator system is known from DE 19828704 A1, in which an energy-rich bundled electron beam is introduced into a plasma chamber delimited, in the longitudinal direction, by an anode and an end electrode, and passed through a magnet arrangement along the center axis. Several intermediate electrodes are provided in the longitudinal direction between the anode and the end electrode, which divide the potential difference between the anode and the end electrode into several stages. The magnet arrangement shows the particular feature that the magnetic field it generates in the plasma chamber periodically changes polarity in the longitudinal direction, and that alternating field segments of the first type and the second type occur in the longitudinal direction, whereby in the segments of the first type, the field lines run predominantly radially, i.e. perpendicular to the longitudinal direction, and in the segments of the second type, the field lines run predominantly axially, i.e. parallel to the longitudinal direction. The segments of the first type preferably lie between two consecutive electrodes, in the longitudinal direction, and form barriers for the electrons accelerated towards the anode. A system structured in this way, in several stages, having the electron barriers, makes it possible to increase the degree of effectiveness of the plasma accelerator. DE 10014033 A1 describes a plasma accelerator system having a similar magnetic field arrangement for a ring-shaped plasma chamber and an electron source that lies on the outside, at the end of the plasma chamber. A plasma accelerator system known from DE 10014033 A1 provides for introduction of the electrons accelerated from the anode side, into a ring-shaped plasma chamber, in the form of a cylindrical hollow beam, into the plasma chamber.

U.S. Pat. No. 6,215,124 B1 describes an ion accelerator according to the type of a Hall thruster, having a ring-shaped plasma chamber and an essentially radial magnetic field between a first magnetic pole that lies radially on the inside and a second magnetic pole that lies radially on the outside. As a particular feature, it is provided here that several electrodes are arranged, in electrically insulated manner, at different radial distances from the exit of the plasma chamber, on the beam exit side of the plasma chamber, at its face that points in the beam direction, which lies essentially crosswise to the beam direction and outside of the plasma chamber, which electrodes lie at different intermediate potentials between the cathode potential and the anode potential, or even below them. A maximum of the longitudinal gradient of the magnetic field is shifted in the direction of the exit of the plasma chamber, and preferably outside it, by means of a magnetic short-circuit about the anode region. A field lens that counteracts the divergence of the ion beam can be generated in the electrostatic acceleration field, by means of the intermediate electrodes on the outside face, and the maximum of the acceleration field can be moved behind the beam exit opening, in the beam direction.

SUMMARY OF THE INVENTION

The present invention is based on the task of further improving such a plasma accelerator system, particularly with regard to the degree of effectiveness.

The invention is described in claim 1. The dependent claims contain advantageous embodiments and further developments of the invention.

By means of the gradation, according to the invention, of the potential difference that exists over the length of the plasma chamber, into a final potential stage on the exit side, having a relatively high potential difference, and one or more potential stages on the anode side, having a comparatively smaller potential difference, in the ratios indicated more precisely in the claims and below, a great potential difference is available in the acceleration stage and therefore at a location where the ion concentration is already high because of the ionization of the preceding stages, for acceleration of the ions to a great velocity, and therefore a great impulse, whereas the potential difference of the preceding stages, which is less, in comparison, is particularly advantageous for the ionization of the working gas. At the same time, however, the acceleration stage is also available for reproduction of the ionization electrons supplied there, by means of pulse ionization, and the resulting secondary electrons.

In this connection and in the following, ionization electrons are understood to mean the electrons that are accelerated towards the anode in the electrostatic field, and generate the positively charged ions of the working gas by means of their movement that is influenced by the magnetic field. At the same time, the term ionization electrons distinguishes these electrons from the electrons designated as neutralization electrons, which are given off to the outside together with the accelerated ion beam and guarantee a charge-neutral plasma beam. Ionization electrons and neutralization electrons can come from the same electron source, at least in part.

The segment between an end electrode arranged at the exit of the plasma beam from the plasma chamber, and an intermediate electrode that comes next to it, in the direction towards the anode, is referred to as a last or exit-side potential stage. The potential difference between the end electrode and the next intermediate electrode that occurs in this potential stage is referred to as the last potential difference.

The magnetic field configuration that is present in the plasma chamber, in connection with the electrode arrangement within the plasma chamber, preferably in the form of a sequence of segments of the first type, having field lines that run predominantly radially, i.e. perpendicular to the longitudinal direction of the plasma chamber, alternating with segments of the second type, having field lines that run predominantly axially, i.e. parallel to the longitudinal direction of the plasma chamber, is of particular significance for the invention, as is, in particular, the magnetic field that exists in the plasma chamber, with the magnetic field segment in the last potential stage, in combination with the great potential difference of the exit-side last potential stage. The intermediate electrodes preferably lie between adjacent magnetic field segments of the first type, having a predominantly radial progression of the magnetic field.

In the last potential stage, in particular, a magnetic field segment of the first type prevents ionization electrons passed to the last potential stage from being highly accelerated, and impacting one of the next electrodes, with the loss of the absorbed energy. Rather, a magnetic field segment of the first type forms a barrier for the electrons accelerated in the electrostatic field, in that the latter are forced onto drift paths having a movement component that runs predominantly crosswise to the longitudinal direction, and reduce the energy from the electrostatic field, step by step, by means of pulse ionization, until they overcome the barrier. In this connection, a high reproduction factor of the ionization electrons is already obtained, even in the next potential stage, referred to as the last stage, so that the last potential stage already passes a high number of electrons on to the next-to-last potential stage.

In this connection, it is advantageous if the magnetic field segment of the first type in the last potential stage lies between the electrodes that form the last stage, particularly in a region where the electrostatic field runs essentially axially and has high values. The ions are not influenced in their movement by the magnetic field, to any noteworthy extent, and are highly accelerated axially by means of the electrostatic field of the last potential stage, whereby it is advantageous that because of the great non-uniformity of the potential stages, according to the invention, the high acceleration in the longitudinal progression of the plasma chamber does not set in until the region in which the degree of ionization of the working gas is very high, so that the last potential stage, which comprises almost the entire potential difference of the system, can be essentially utilized for the acceleration of all working gases.

It is advantageous if the last potential difference amounts to at least four times, particularly at least ten times the first potential difference, i.e. the potential difference between the electrode that faces away from the plasma exit and the next intermediate electrode in the direction of the plasma exit. The segment between the anode and the intermediate electrode next closest to it is referred to as the first potential difference.

In the case of more than one intermediate electrode between the anode and the end electrode, additional intermediate potential stages between consecutive intermediate electrodes occur accordingly. It is then advantageous if the potential difference of the last potential stage amounts to at least four times, particularly at least ten times the greatest potential difference of the other potential stages.

It is advantageous if the last potential difference is greater than the sum of the other potential differences, and if it amounts to preferably at least two times, particularly at least four times the sum of the other potential differences.

It proves to be advantageous that the intermediate potentials of the intermediate electrodes do not have to be predetermined in fixed and compulsory manner, but rather that one or more intermediate electrodes can also lie at sliding potentials.

According to an advantageous embodiment, the end electrode can be formed by an electrode that surrounds the plasma chamber at the exit of the plasma beam and/or delimits it laterally. In another advantageous embodiment, the end electrode can also be arranged outside the plasma chamber, at the plasma beam exit, particularly also according to the type of the cathodes of the Hall thruster systems, with a lateral offset.

The ionization electrons that initiate ionization can be passed to the last potential stage in known manner. For example, an accelerated electron beam can be introduced into the plasma chamber from the anode side of the latter, and be centrally guided in the longitudinal direction by means of the magnetic field arrangement. The electrons of the electron beam ES are braked in the electric field. One part of the electrons of the electron beam is deflected at the end of the first potential stage, and accelerated towards the anode as ionization electrons. Another part of the electrons of the electron beam exits from the chamber with the working gas ions, as an electrically neutral plasma beam. In another manner, similar to the Hall thrusters, an electron source is arranged outside the plasma chamber, near the exit of the plasma beam, with a lateral offset, and emits an electron stream that is partly passed into the plasma chamber as ionization electrons, through the plasma beam exit, and partly carried along by means of the volume charge effects of a non-neutralized ion beam, and causes an electrically neutral plasma beam to be issued. In yet another embodiment, an electrode can be provided at the exit of the plasma beam from the plasma chamber, which electrode is exposed to a border region of the plasma beam. The ions, which are already highly accelerated at this position, release an electron shower upon impact on this electrode and/or release electrons due to volume charge effects, which again are partly accelerated as ionization electrons, in the anode direction, and partly carried along to neutralize the plasma beam. To generate an initial ion stream, a gas discharge can be ignited by means of briefly raising the gas pressure and/or the potential difference of the last potential stage, for example. However, a start can take place solely by means of spontaneous ionization, e.g. by means of high-energy cosmic radiation. The different types of electron sources can also be implemented in combined manner.

BRIEF DESCRIPTION OF THE DRAWINGS

The invention will be explained in greater detail below, using preferred exemplary embodiments, making reference to the figures. These show.

DETAILED DESCRIPTION OF PREFERRED EMBODIMENTS

Figure 1:
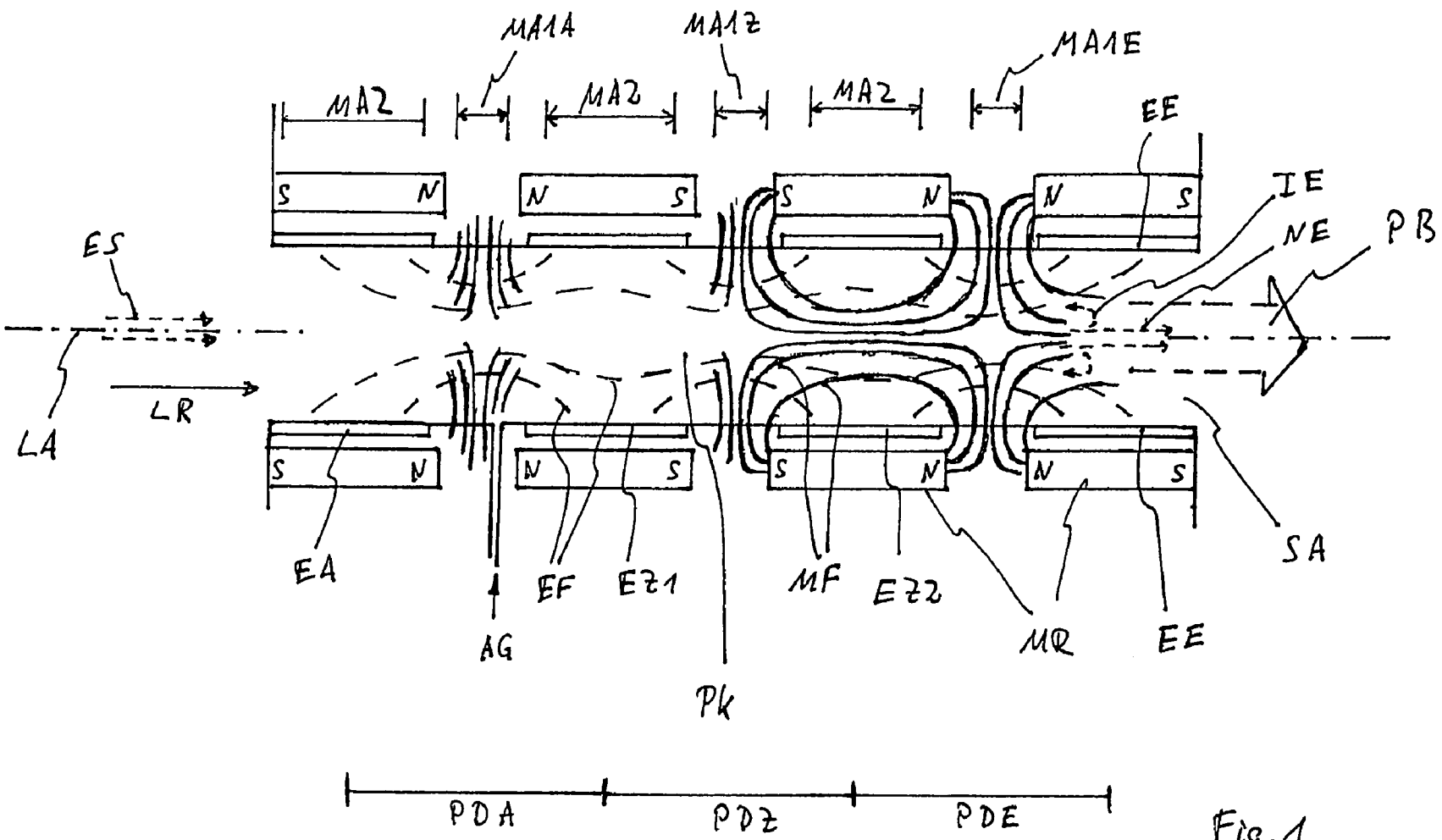
FIG. 1 a longitudinal cross-section through a plasma chamber.

In the plasma accelerator system shown in FIG. 1, a plasma chamber PK is structured essentially as a circular cylinder about the longitudinal axis LA. The plasma chamber is surrounded by several electrodes EA, EZ1, EZ2, EE, preferably ring-shaped, that follow one another at a distance in the longitudinal direction LR and are at different potentials. A working gas AG, preferably xenon, is passed to the plasma chamber.

A tightly bundled, highly accelerated electron beam ES from a beam source, not shown, is introduced into the plasma chamber on the longitudinal axis, from the side of the first electrode EA, also referred to as an anode, and centrally passed through the magnetic field MF of a magnet arrangement that surrounds the plasma chamber, on the longitudinal axis LA.

The potential progression over the different potentials of the separate electrodes is monotonous in the longitudinal direction LR and directed in such a manner that the electrons of the electron beam are braked along their path through the plasma chamber, and positively charged ions of the working gas, generated in the plasma chamber, are accelerated in the direction of the electrode EE, which is arranged as the last electrode of the series, at the beam exit SA of the plasma chamber. Ions and electrons NE leave the plasma chamber at the beam exit, as an electrically neutral plasma beam PB.

The magnet arrangement is schematically represented by several magnet rings MR that surround the plasma chamber, which alternately have opposite poling, following one another in the longitudinal direction.

Such a magnet arrangement produces a magnetic field in the plasma chamber, which has segments MA1A, MA1Z, MA1E of the first type, in the longitudinal direction, at positions between consecutive magnet rings, in which the magnetic field MF is predominantly directed radially.

The magnetic field segments of the first type form electron barriers in the potential stages formed by two consecutive electrodes, in each instance, having a first potential difference PDA for the first, anode-side potential stage between the anode EA and the first intermediate electrode EZ1, an intermediate potential difference PDZ for an intermediate stage between the first (EZ1) and the second (EZ2) intermediate electrode, and a last, exit-side potential difference PDF for the last potential stage between the second intermediate electrode EZ2 and the end electrode EE, in that electrons accelerated in the electrostatic field EF of the electrode arrangement, at a distance from the longitudinal axis, are deflected by the magnetic field and held in a stage for a long time. As a result, the probability of the ionizing interaction with the working gas and therefore also the measure of reproduction of the electrons by means of the secondary electrons released during ionization is greatly increased.

According to the invention, the potential difference PDE of the last potential stage amounts to at least four times, particularly at least ten times the potential difference PDA of the first potential stage or, in the case of more than two potential stages, to at least four times, particularly at least ten times the greatest of the potential differences PDA, PDZ of the other potential stages. It is advantageous if these potential differences PDA, PDZ of the other potential stages are less than the last potential difference PDE, and preferably amount to a maximum of 50%, particularly a maximum of 25%, of the last potential difference PDE. For example, a selection can be made so that PDA=50 V, PDZ=50 V, and PDE=900 V.

The number of electrons suitable for ionization increases steeply from stage to stage, from the last potential stage to the first potential stage, as a result of the reproduction factor. The major portion of the ionization of the working gas therefore lies in the potential stages PDA and PDZ. Because of the magnetic field segment MA1E of the first type in the last potential stage, however, electron beams that are greatly braked in this stage, in the electron beam that is introduced, are held in this stage for a long time and thereby already generate a large number of secondary electrons, which are transferred to the next stage in the direction towards the anode. At the same time, the concentration of the ions accelerated in the direction from the anode EA to the end electrode EE has approximately reached its maximum upon entry into the last potential stage, so that the great potential difference of this last potential stage is essentially available as an acceleration potential for the entire ion stream.

The combination of the high last potential difference PDE and the magnetic field segment MA1E in the last potential stage therefore leads to a particularly good degree of effectiveness of the plasma accelerator system.

It is advantageous if the other potential stages also have magnetic field segments MA1A, MA1Z of the first type, which alternate with magnetic field segments MA2 of the second type, following one another in the longitudinal direction, in which the magnetic field in the plasma chamber runs predominantly axially, i.e. parallel to the longitudinal direction. A particularly high ionization portion is achieved in the first potential stage.

For a better differentiation, magnetic field segments of the first and the second type are shown spaced apart by transition segments in the figures.

Because of the progression of the magnetic field, divergent from the longitudinal axis, in the segments of the first type and the predominantly axial progression in the segments of the second type, the electrons are kept away from the lateral electrodes, for the most part, and are maintained as ionization electrons.

Figure 2:
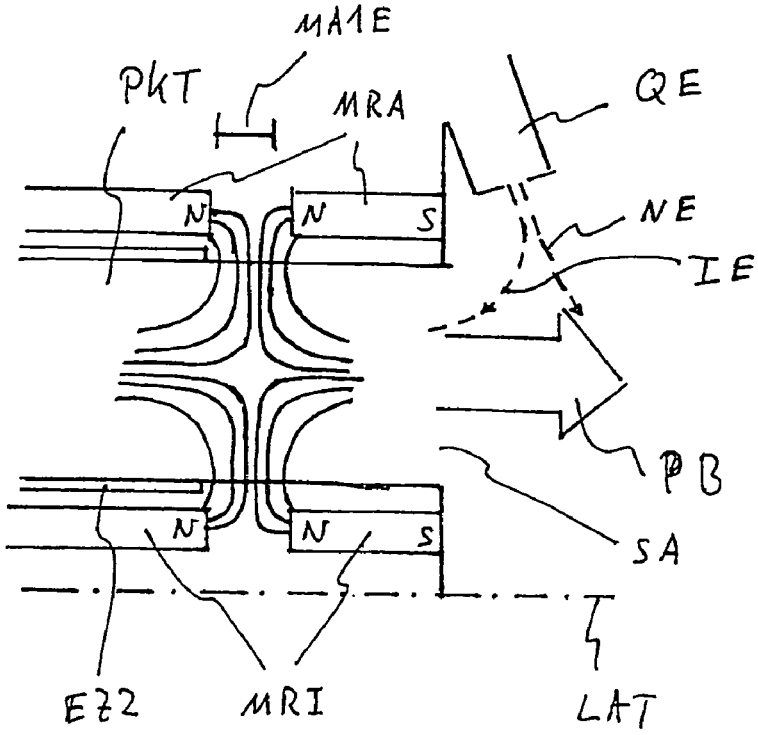
FIG. 2 a system having an electron source located on the outside.

While the initial ionization electrons IE are obtained in the last potential stage in that part of the electrons of the electron beam that is introduced does not overcome the potential of the end electrode and is branched out of the electron beam and accelerated in the opposite direction, in the system shown in FIG. 1, an embodiment shown in FIG. 2 for the region of the plasma beam exit SA provides a cathode arranged outside the plasma chamber PK1, in the manner of a Hall thruster, as the electron source QE, the emitted electron stream of which is passed in part to the plasma chamber, as ionization electrons IE, through the beam exit SA, and in part carried along by the plasma beam PB, as neutralization electrons NE. In the case of such an arrangement, the end electrode can be formed by this cathode, so that the last potential stage is formed between the cathode EQ and the intermediate electrode closest to the exit.

In the plasma chamber, again, a magnetic field segment MA1E of the first type, having the described effect on the ionization electron accelerated in the direction of the intermediate electrode by the cathode EQ, is present between the beam exit SA and the intermediate electrode EZ2. In FIG. 2, in contrast to FIG. 1, the plasma chamber is assumed to have a conventional embodiment, in ring shape about a longitudinal axis LAT. The magnet arrangement then contains inner and outer magnet rings MRI and MRA, which lie opposite one another radially and have the same poling. However, the generation of the primary electrodes is independent of the circular or ring-shaped chamber geometry and, in particular, the external cathode EQ is suitable as an electron source for both geometries.

Figure 3:
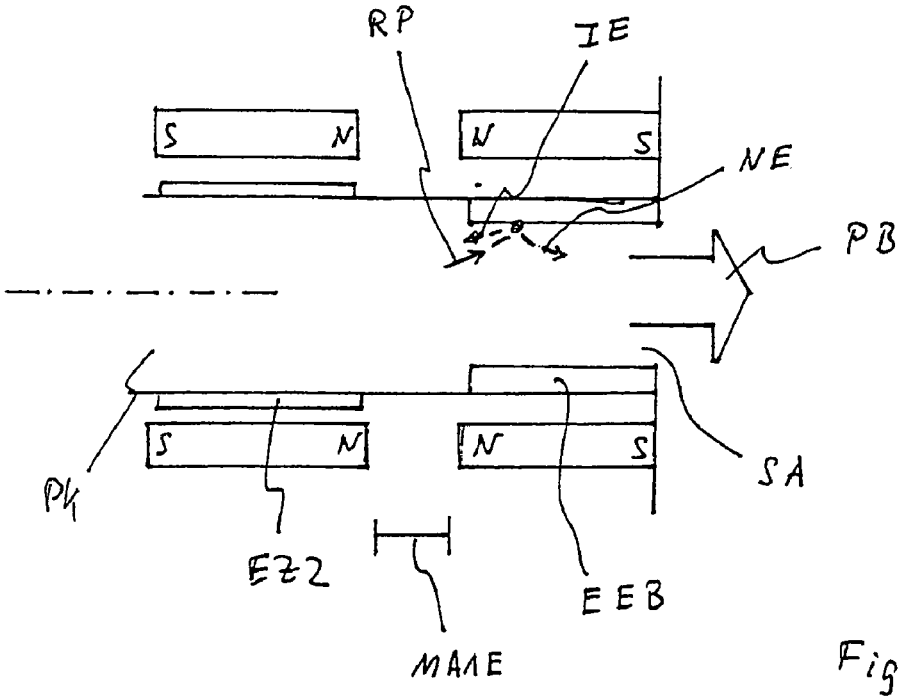
FIG. 3 a system having an ion-impacted electrode as the electron source.

Another possibility for the generation of ionization electrons in the last potential stage is shown in FIG. 3. Here, the end electrode EEB is exposed to the bombardment and/or field influence of ions from an edge region RP of the plasma beam. Ions that impact the end electrode release electron showers, for example, which are partly accelerated towards the intermediate electrode EZ2, as ionization electrons, and partly are also carried along by the plasma beam, as a neutralization electron stream NE. It is advantageous if the end electrode EEB consists of material resistant to the ion bombardment, having a high secondary electron emission coefficient. Again, the magnetic field segment MA1E is provided between the end electrode EE4 and the intermediate electrode EZ2, but the field progression is not explicitly shown in this drawing. The passive electrode is also particularly advantageous in combination with intermediate electrodes at sliding potentials.

The characteristics indicated above and in the claims, as well as evident from the drawings, can be advantageously implemented both individually and in various combinations. The invention is not restricted to the exemplary embodiments described, but rather can be modified in many different ways, within the scope of the ability of a person skilled in the art.

The invention claimed is:

1. A plasma accelerator system comprising:

(a) an anode;

(b) an end electrode;

(c) a plasma chanter between said anode and said end electrode, said end electrode being spaced apart from the anode in a longitudinal direction of the plasma chamber at an exit of a plasma beam from the plasma chamber;

(d) at least one intermediate electrode arranged between the anode and the end electrode in the longitudinal direction, said at least one intermediate electrode lying electrically at intermediate potentials; and (e) a magnet arrangement generating a magnetic field in the plasma chamber, said magnetic field comprising a first set of first magnetic field segments and a second set of second magnetic field segments, said first magnetic field segments running predominantly perpendicular to the longitudinal direction in an area that comprises the end electrode and the intermediate electrode that lies closest to said end electrode in the longitudinal direction, said second magnetic field segments running parallel to the longitudinal direction, each first magnetic field segment having an adjacent second magnetic field segment on each side of the first magnetic field segment in the longitudinal direction;

wherein a last potential difference between the end electrode and the intermediate electrode that lies closest to said end electrode amounts to at least four times a first potential difference between the anode and the intermediate electrode that lies closest to said anode.

2. The system according to claim 1, wherein ionization electrons are passed to the plasma chamber from the side of the end electrode.

3. The system according to claim 2, wherein an electron source is arranged on the side of a plasma beam exit, outside the plasma chamber.

4. The system according to claim 2, wherein at the exit from the plasma chamber, part of the plasma beam is passed to the end electrode, and the end electrode releases ionization electrons when this happens.

5. The system according to claim 1, wherein a bundled, accelerated electron beam is passed to the plasma chamber from the side of the anode.

6. The system according to claim 1, wherein one of the first magnetic field segments lies between the end electrode and the intermediate electrode that lies closest to said end electrode in the longitudinal direction.

7. The system according to claim 1, wherein several first magnetic field segments follow one another alternately with second magnetic field segments in the longitudinal direction.

8. A plasma accelerator system comprising:

(a) an anode;

(b) an end electrode;

(c) a plasma chamber between said anode and said end electrode, said end electrode being spaced apart from the anode in a longitudinal direction of the plasma chamber at an exit of a plasma beam from the plasma chamber;

(d) at least one intermediate electrode arranged between the anode and the end electrode in the longitudinal direction, said at least one intermediate electrode lying electrically at intermediate potentials; and (e) a magnet arrangement generating a magnetic field in the plasma chamber, said magnetic field comprising a first set of first magnetic field segments and a second set of second magnetic field segments, said first magnetic field segments running predominantly perpendicular to the longitudinal direction in an area that comprises the end electrode and the intermediate electrode that lies closest to said end electrode in the longitudinal direction, said second magnetic field segments running parallel to the longitudinal direction, each first magnetic field segment having an adjacent second magnetic field segment on each side of the first magnetic field segment in the longitudinal direction;

wherein a last potential difference between the end electrode and the intermediate electrode that lies closest to said end electrode amounts to at least four times a first potential difference between the anode and the intermediate electrode that lies closest to said anode; and wherein several intermediate electrodes are present with at least one intermediate potential difference between consecutive intermediate electrodes in the longitudinal direction and the last potential difference amounts to at least four times the greatest of the intermediate potential differences or the first potential difference.

9. A plasma accelerator system comprising:

(a) an anode;

(b) an end electrode;

(c) a plasma chamber between said anode and said end electrode, said end electrode being spaced apart from the anode in a longitudinal direction of the plasma chamber at an exit of a plasma beam from the plasma chamber;

(d) at least one intermediate electrode arranged between the anode and the end electrode in the longitudinal direction, said at least one intermediate electrode lying electrically at intermediate potentials; and (e) a magnet arrangement generating a magnetic field in the plasma chamber, said magnetic field comprising a first set of first magnetic field segments and a second set of second magnetic field segments, said first magnetic field segments running predominantly perpendicular to the longitudinal direction in an area that comprises the end electrode and the intermediate electrode that lies closest to said end electrode in the longitudinal direction, said second magnetic field segments running parallel to the longitudinal direction, each first magnetic field segment having an adjacent second magnetic field segment on each side of the first magnetic field segment in the longitudinal direction;

wherein a last potential difference between the end electrode and the intermediate electrode that lies closest to said end electrode amounts to at least four times a first potential difference between the anode and the intermediate electrode that lies closest to said anode; and wherein the sum of the first and at least one intermediate potential differences not including the last potential difference is not greater than the last potential difference.

10. The system according to claim 9, wherein the sum of the first and at least one intermediate potential differences not including the last potential difference is not greater than 50% of the last potential difference.

11. The system according to claim 10, wherein the sum of the first and at least one intermediate potential differences not including the last potential difference is not greater than 25% of the last potential difference.

* * * * *